US008500146B2

(12) United States Patent
Genov et al.

(10) Patent No.: US 8,500,146 B2
(45) Date of Patent: Aug. 6, 2013

(54) SKATE BOARD

(75) Inventors: Toly Genov, San Jose, CA (US); Zlatko Sotirov, Santa Clara, CA (US); Alex Todorov, Santa Clara, CA (US); Marlowe Markov, Los Angeles, CA (US); Kalin Stefanov, San Jose, CA (US)

(73) Assignee: Romulus Investments, LLC, Saratoga, CA (US)

( * ) Notice: Subject to any disclaimer, the term of this patent is extended or adjusted under 35 U.S.C. 154(b) by 0 days.

(21) Appl. No.: 13/191,381

(22) Filed: Jul. 26, 2011

(65) Prior Publication Data

US 2013/0026728 A1 Jan. 31, 2013

(51) Int. Cl.
*B62M 1/00* (2010.01)

(52) U.S. Cl.
USPC ..... 280/87.042; 280/11.28; 301/5.303; 301/5.305

(58) Field of Classification Search
USPC ..... 280/11.27, 11.28, 87.01, 87.041, 280/87.042; 301/5.1, 5.21, 5.301, 5.303, 301/5.7, 5.304, 5.305
See application file for complete search history.

(56) References Cited

U.S. PATENT DOCUMENTS

| | | | | |
|---|---|---|---|---|
| 4,047,727 | A * | 9/1977 | Holladay et al. | 280/87.042 |
| 4,603,868 | A * | 8/1986 | Schutz | 280/7.13 |
| 5,096,225 | A * | 3/1992 | Osawa | 280/842 |
| 5,263,725 | A * | 11/1993 | Gesmer et al. | 280/11.28 |
| 7,219,907 | B2 * | 5/2007 | Chang | 280/87.042 |
| 7,243,925 | B2 * | 7/2007 | Lukoszek | 280/11.28 |
| 8,186,694 | B2 * | 5/2012 | Nelson et al. | 280/11.28 |
| 2006/0213711 | A1 * | 9/2006 | Hara | 180/181 |
| 2009/0256325 | A1 * | 10/2009 | Dickie | 280/87.042 |
| 2011/0079976 | A1 * | 4/2011 | Seip | 280/87.042 |

* cited by examiner

*Primary Examiner* — John Walters
*Assistant Examiner* — Brian Swenson
(74) *Attorney, Agent, or Firm* — Nixon Peabody LLP; Khaled Shami

(57) ABSTRACT

Skateboard designs including a hanger with a yoke with two arms, comprising a bumper which provides an increasing force as the wheel axles are pushed away from their resting position, and wide wheels with an asymmetrical and gradually tapering profile as the wheel extends outward from the midline of the board, for improved "surfing-like" maneuverability including an enhanced ability to "carve" like a snowboard.

20 Claims, 10 Drawing Sheets

SKATE BOARD

TECHNICAL FIELD

This subject matter relates generally to skateboard wheels and assemblies.

BACKGROUND

Skateboards first became widely popular in the early 1960s, during a surfing craze. Surfers often used improvised skateboards comprised of wooden boards attached to roller skate wheels, as a way to practice surfing when suitable waves were unavailable. As a partial replication of surfing, skateboards are partially recreate the sensation of snowboarding.

Skateboards operate by a rider standing on the board and being propelled either by gravity or by the pumping of his or her legs to propel the board forward. Boards are mainly controlled by the distribution of weight. For example, as a rider shifts weight to the right or left side of the board, it causes the board to rotate slightly along the longitudinal axis of the board, which in most skateboards also causes the wheel axles to turn slightly around a "kingpin" axis tilted forward or backward from the vertical axis, which allows the skateboard to turn right or left. In most skateboards, the wheels are associated with a compliant mechanism such as a spring which causes a resistance force whenever the wheel axles deviate from their resting position, which is usually perpendicular to the longitudinal axis of the board, and parallel to the board's left-right axis.

In most skateboards, the wheel axles are part of an assembly called a truck. A truck typically has at least two parts: (1) a fixed base attached to the underside of the deck, and (2) a movable part, called a hanger, which is attached to the base through a bolt (called a kingpin) at an angle to the vertical axis. The chosen angle for the kingpin may dictate the amount of turning (around the vertical or yaw axis) that will result from a given degree of tilt of the deck around the longitudinal or roll axis of the deck. Between the base and the hanger, there is typically a compliant member, such as a spring or elastic material, which creates force when the hanger is rotated around the kingpin some distance from its rest position.

The hangar portion of the truck typically contains two axles, one on either side, for the wheels. In the resting position, these axles typically protrude at right angles to the longitudinal axis of the board. Skateboard wheels are typically roughly cylindrical, usually but not always rounded edges. Some wheels are also torus-shaped. In normal operation, cylindrical wheels are intended to engage with the paved ground surface, and maintain a region of flat contact with that surface, for maximum friction and to prevent slippage. Torus-shaped wheels have less of a flat surface to engage the paved ground in the wheel's fully-horizontal rest-state, but may be tilted more before losing ground friction.

A problem with prior art skateboard designs is that there is a limit to the amount that the deck can roll along the longitudinal axis, before the wheels tilt so far that they lose their normal engagement with the paved surface. If the wheels are roughly cylindrical, and the truck reaches its maximum rotation around the kingpin, the wheel may tilt upon its edge, leaving only a thin edge to engage the paved surface. Regardless of whether the wheel is cylindrical or more torus-shaped, the tilt may be so great that one of the two wheels on each truck leaves the paved surface entirely, leaving a single wheel to engage the paved surface. The loss of friction caused by the reduction in connection between the wheels and the paved surface is usually undesirable, as it may result in slippage and loss of control.

Thus, in normal operation, skateboards are typically limited in the degree of deck roll they can sustain before there is a loss of control and effective steerage. Thus, traditional prior art skateboards cannot very well replicate the steep angles and turns that a surf board would undergo during surfing or snowboarding. The ability to roll the deck at deep angles and cut tight left and right turns with a skateboard is called carving (borrowed terminology from the field of snowboarding), and the ability to carve deeply is widely recognized as a beneficial feature of skateboards.

There have been a few attempts to overcome the traditional skateboard design to allow deep carving similar to what one might experience in surfing or snowboarding. None of these attempts has been entirely successful, however. One strategy is the use of inline wheels. There have been many inline skateboard designs, a recent example of which is described in WO/2007/034436. This design has the disadvantage of lack of stability. The board has only a thin line of wheels along its longitudinal axis, and the rider must balance on those wheels the way they might balance on one foot while riding on inline roller skates.

Another strategy for making a "surfable" skateboard is to provide the board with swiveling wheels, much like the wheels on a shopping cart. An example of this design is shown in U.S. Pat. No. 6,206,389. This design has a number of disadvantages, among the most important being the lack of control, and the loss of a skateboard "feel" caused the inability to steer the board in the way that one might steer a surfboard or a snowboard.

Yet another strategy, described in U.S. Pat. No. 5,553,874, is to provide trucks with large, curved axles spanning an arc from the right to the left side of the board, and fill the axle with multiple wheels, so that the board can roll left and right at a steep angle. Like the other attempts at creating a surf-like or snowboard-like skateboard, this design has a number of disadvantages, including instability, difficulty of control, and the loss of the traditional skateboard action and feel. Another disadvantage is that the wheels are difficult to replace, as replacement requires significant disassembly.

What is needed is a skateboard truck and wheel design that allows for deep "carving" similar to what one might experience on a surfboard or snowboard. including large angle left and right rolls with accompanying sharp turns, in a manner where the board maintains stability and contact with the paved surface, and the board is responsive to the rider's steering in roughly the same way that steering occurs on a surfboard or snowboard.

BRIEF SUMMARY

The present disclosure relates to a skateboard, as well as a skateboard assembly and wheels, that in combination allow the rider to "carve" deeply by shifting his or her weight.

Among the various embodiments disclosed herein are a skateboard comprising a deck and two wheel assemblies, one toward the front and one toward the back of the board. Each wheel assembly may comprise a truck and two wheels. Each wheel may have a substantially circular cross-section within each plane that perpendicularly intersects the wheel's rotational axis. Each such cross-section, as a function of distance from the wheel's inner edge, may have a maximum, preferably toward the inside edge of the wheel, or at the inside edge of the wheel.

The profile of the wheel may be tapered, so that the slope of the function representing the diameter as a profile versus the distance from the inside edge of the wheel may have a decreasing slope, particularly as the wheel tapers toward its outside edge. From the point of its maximum to the outside edge, this function is preferably monotonically decreasing. The curve may take a variety of shapes, including without limitation a part of a circle, ellipse, spline, parabola, or Bezier curve. The diameter at the edge of the wheel may be substantially smaller than the maximum diameter. The wheel is preferably elongated so that the dimensions of its width are about the same as its diameter, or it is wider than its diameter.

In addition, there is described herein a truck design that includes a base portion fixedly attached to the board, having a first substantially vertical surface facing the left side of the deck, and a second substantially vertical surface facing the right side of the deck. A kingpin may be attached to the base, and attached to the hangar. The kingpin may preferably be at a specified oblique angle from the horizontal axis.

A hanger, with attached axle(s) may be attached to the kingpin, so that the hanger is free to rotate about the longitudinal axis of the kingpin while the base remains relatively stationary. A bumper yoke can be fixedly attached to the hanger. The yoke can have two arms, each adjacent on its inner surface to a vertical surface on the base. Between the yoke arms and the vertical surfaces of the base, there may be compliant members, which provide a compression force that increases as the hanger rotates away from its nominal position.

Various additional embodiments, including additions and modifications to the above embodiments, are described herein.

BRIEF DESCRIPTION OF THE DRAWINGS

The accompanying drawings, which are incorporated into this specification, illustrate one or more exemplary embodiments of the inventions disclosed herein and, together with the detailed description, serve to explain the principles and exemplary implementations of these inventions. One of skill in the art will understand that the drawings are illustrative only, and that what is depicted therein may be adapted, based on this disclosure, in view of the common knowledge within this field.

In the drawings.

DETAILED DESCRIPTION

Various example embodiments of the present inventions are described herein in the context of providing a "deep carving" skateboard, truck assembly, and wheels.

Those of ordinary skill in the art will understand that the following detailed description is illustrative only and is not intended to be in any way limiting. Other embodiments of the present inventions will readily suggest themselves to such skilled persons having the benefit of this disclosure, in light of what is known in the relevant arts, the provision and operation of information systems for such use, and other related areas.

Not all of the routine features of the exemplary implementations described herein are shown and described. In the development of any such actual implementation, numerous implementation-specific decisions must be made in order to achieve the specific goals of the developer, such as compliance with regulatory, safety, social, environmental, health, and business-related constraints, and that these specific goals will vary from one implementation to another and from one developer to another. Moreover, such a developmental effort might be complex and time-consuming, but would nevertheless be a routine undertaking of engineering for those of ordinary skill in the art having the benefit of this disclosure.

Throughout the present disclosure, relevant terms are to be understood consistently with their typical meanings established in the relevant art. However, without limiting the scope of the present disclosure, exemplary clarifications and descriptions of certain terms are provided for relevant terms and concepts as set forth below:

The term deck as used herein means the platform of a skateboard. There are many kinds of decks, and they may be composed of many different materials. They are rigid so that they may hold the weight of the rider, and are also preferably somewhat flexible to absorb shock for a smoother ride.

The term truck as used herein means an assembly attached to the deck that holds the wheels of the skateboard. It typically comprises a base and a hanger. The base typically fixedly attached to the deck, and the hanger is a movable portion to which the wheels are attached via axles.

The term kingpin as used herein means a bolt attached to both the base and the hanger, about which the hanger rotates. The kingpin is can be at an oblique angle to the horizontal axis. The front kingpin may point downward in the direction of the rear of the board, while the rear kingpin may point downward in the direction of the front of the board.

Figure 1:
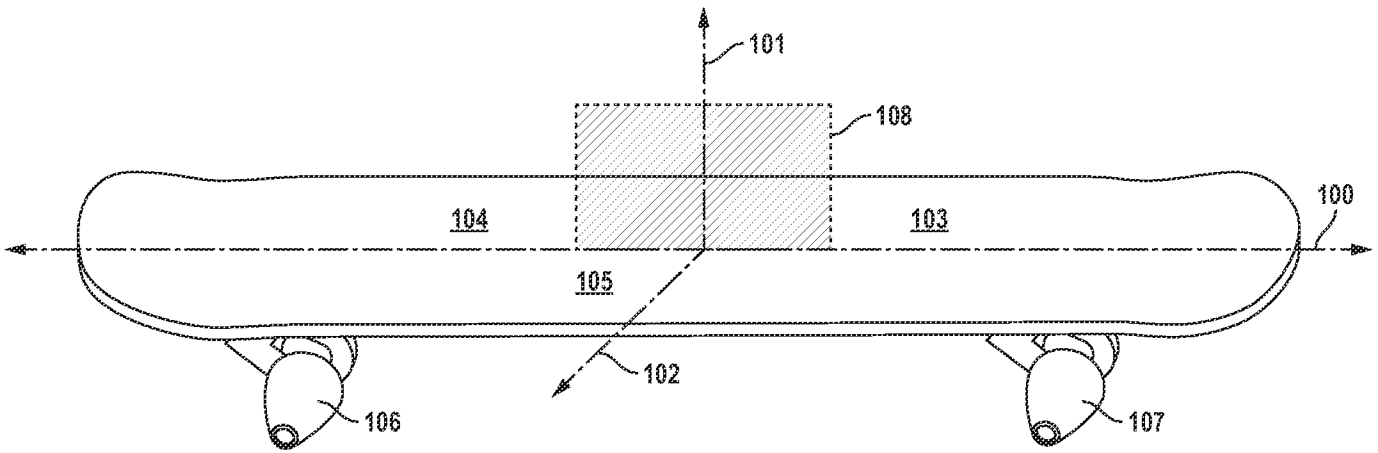
FIG. 1 shows a skateboard, oriented in three axes.

FIG. 1 shows a skateboard oriented in three axes. This skateboard comprises a deck 105 and wheel assemblies 106 and 107. The skateboard may be elongated along a longitudinal axis 100, having front 103 and rear 104 portions with respect to the longitudinal axis, the deck 105 also having a perpendicular vertical axis 101 pointing upward as the skateboard rests on the ground, and a perpendicular lateral axis 102 extending from left to right from the perspective of a rider standing on the board facing the front 103 of the board, separated by a lateral midline plane 108 into a left side and a right side. Other skateboard configurations are possible, including boards with three or more wheel assemblies, or a single wheel assembly, which may make use of the wheel assemblies and wheels disclosed herein.

Figure 2:
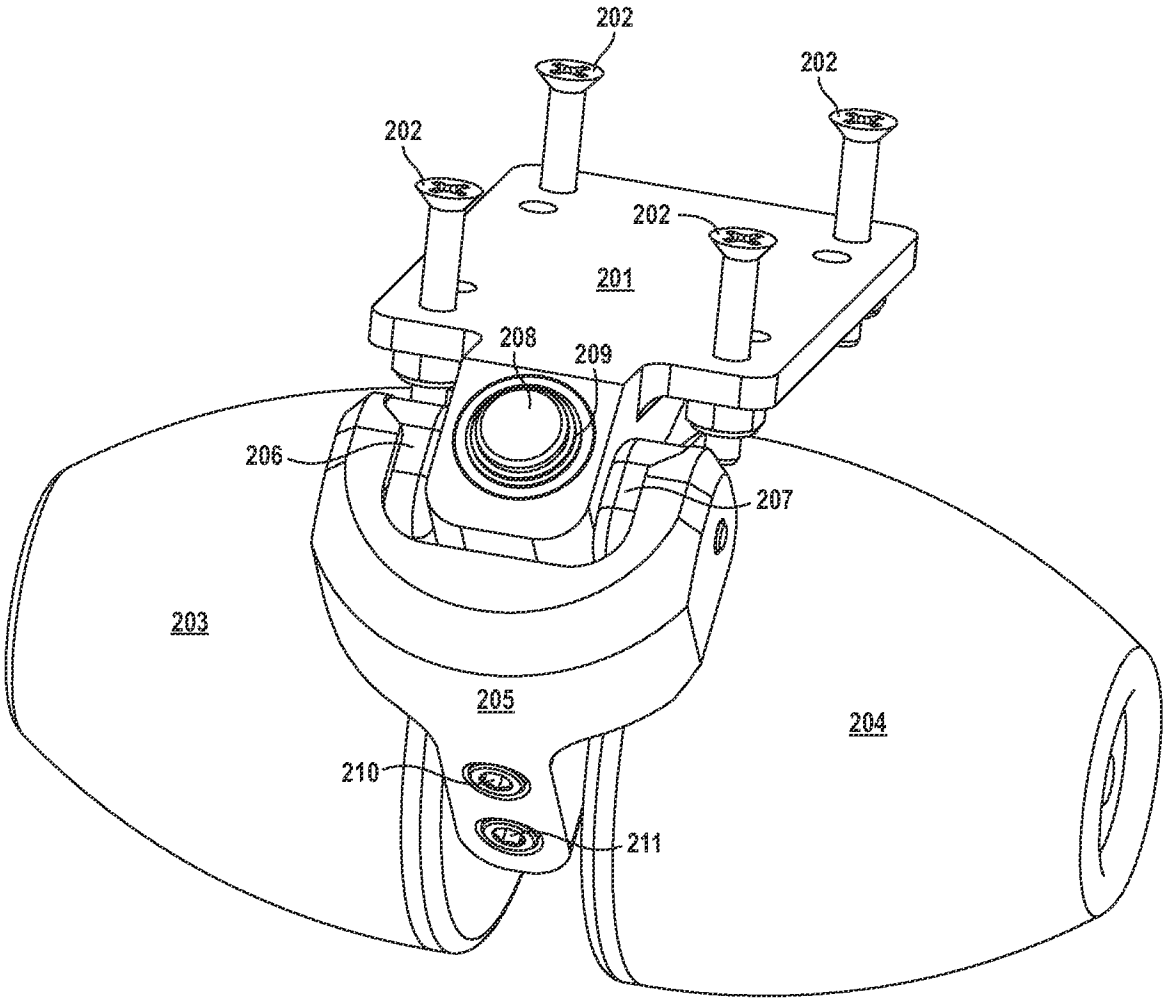
FIG. 2 shows an example wheel assembly, including wheels and truck.

FIG. 2 shows one embodiment of a wheel assembly. The assembly includes a base 201, which is normally attached to the deck 105 (not shown) through bolts 202. The depicted wheel assembly has two wheels 203 and 204. A bumper yoke 205, with elastomeric bumpers 206 and 207. Kingpin 208 is attached to base 201 via a retaining ring 209.

Figure 3:
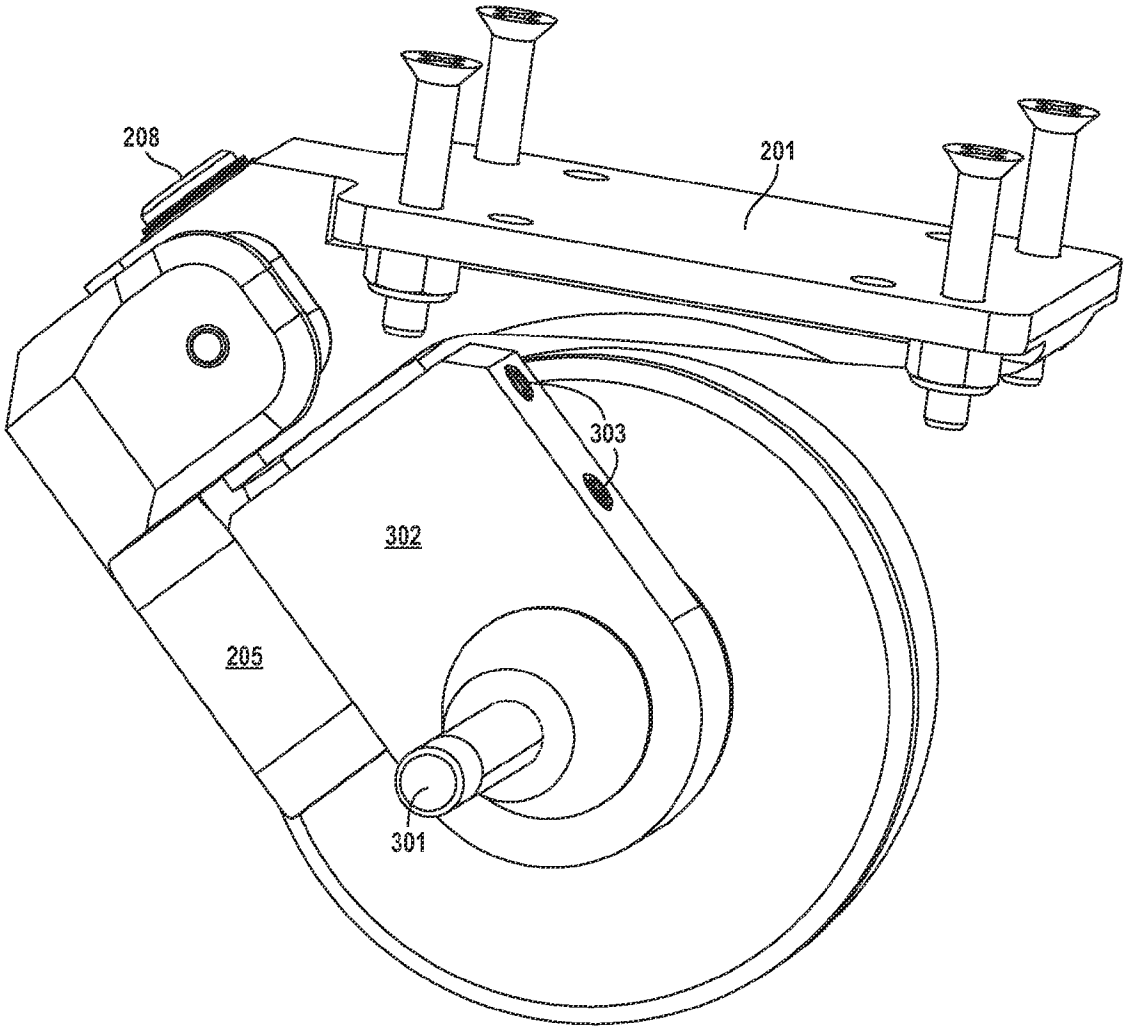
FIG. 3 illustrates the wheel assembly with one wheel removed.

FIG. 3 shows a side view of the wheel assembly, with one wheel removed, along with its attachments to the axle 301. Kingpin 208 passes through base 201 and into hangar 302. Bumper yoke 205 may be bolted to hangar 302 by bolts 210 an 211 (shown in FIG. 2). The kingpin 208 may be held in place by socket set screws 303. Hangar 302 as depicted here is fixedly attached to the kingpin 208, while the kingpin may rotate about its axis within the base 201, riding on one or more bushings (not shown) within base 201. In an equivalent embodiment, the kingpin would be fixedly attached to base 201, and hangar 302 may be capable of rotating around the kingpin.

Alternative arrangements of the above components may be suggested to one of skill in the art.

Figure 4:
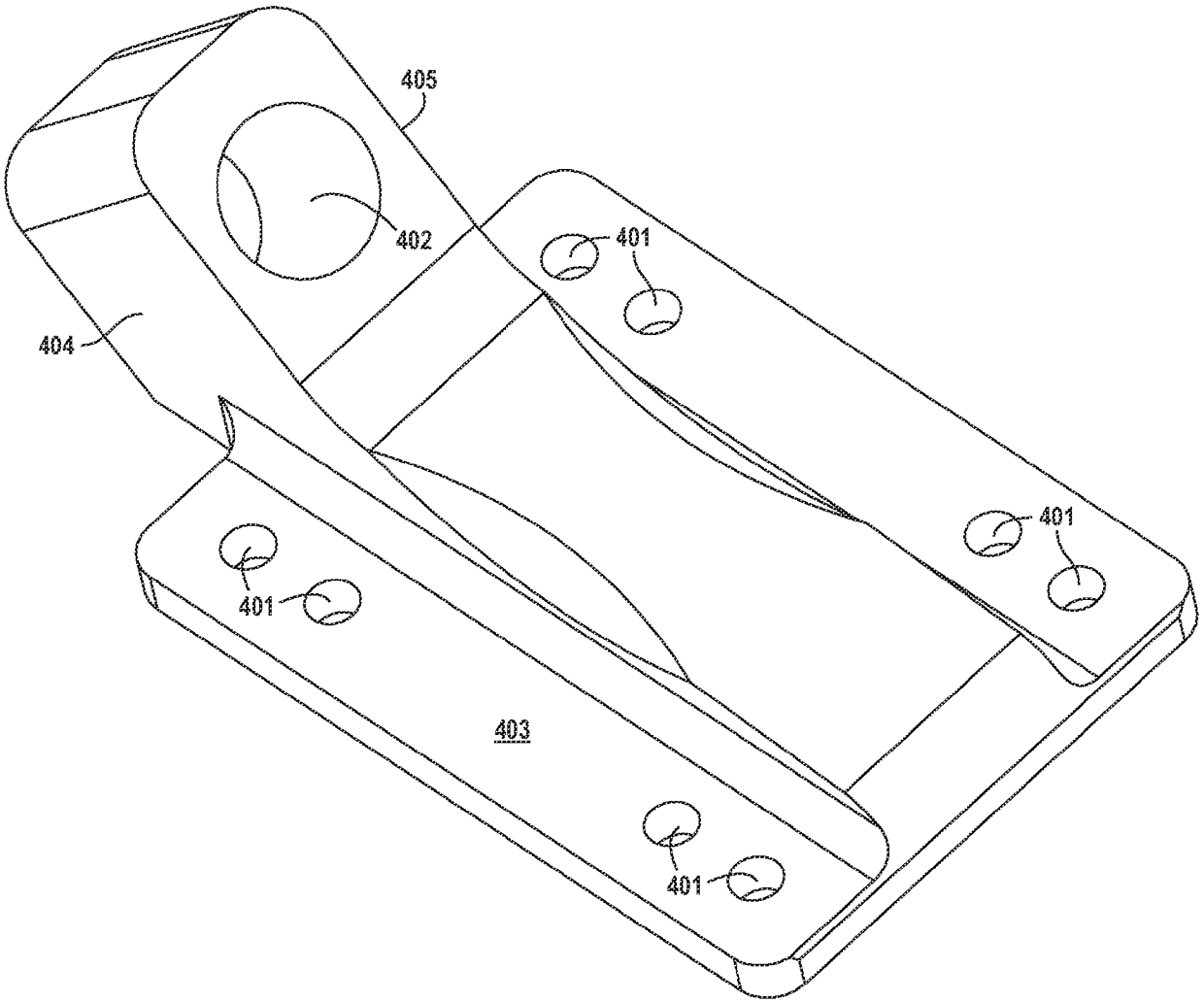
FIG. 4 shows an example truck base.

In one embodiment of the wheel assembly, the base 201 is fixedly attached to deck 105. Another view of an example base is shown in FIG. 4, showing a bottom view of the base. The base has bolt holes 401 for attachment to the deck, and a kingpin hole 402 which engages the kingpin (preferably). Preferably, bushings may be provided between the kingpin and the kingpin hole to promote free rotation of the kingpin. The hole 402 is preferably angled at an oblique angle in relation to the horizontal plane of base 201 and consequently deck 105. This angle, if provided, allows the wheel assembly to both turn and tilt in relation to the plane of the deck. This aids the maneuverability of the skateboard by allowing the rider to turn the wheels by shifting weight from side to side, while at the same time tilting the board toward the turn.

When the kingpin is inserted in hole 402, it makes an angle with the horizontal surface 403 of the base. This angle may in theory be any angle from 0° to 90° in any direction. Preferably, however, this angle may be between about 40° to 65°, and more preferably between about 50° to 60°, and most preferably 55° in this embodiment. Various factors may affect the optimal angle, including the rider's preference, the space between the wheel assemblies, and the size of the wheels.

Figure 5:
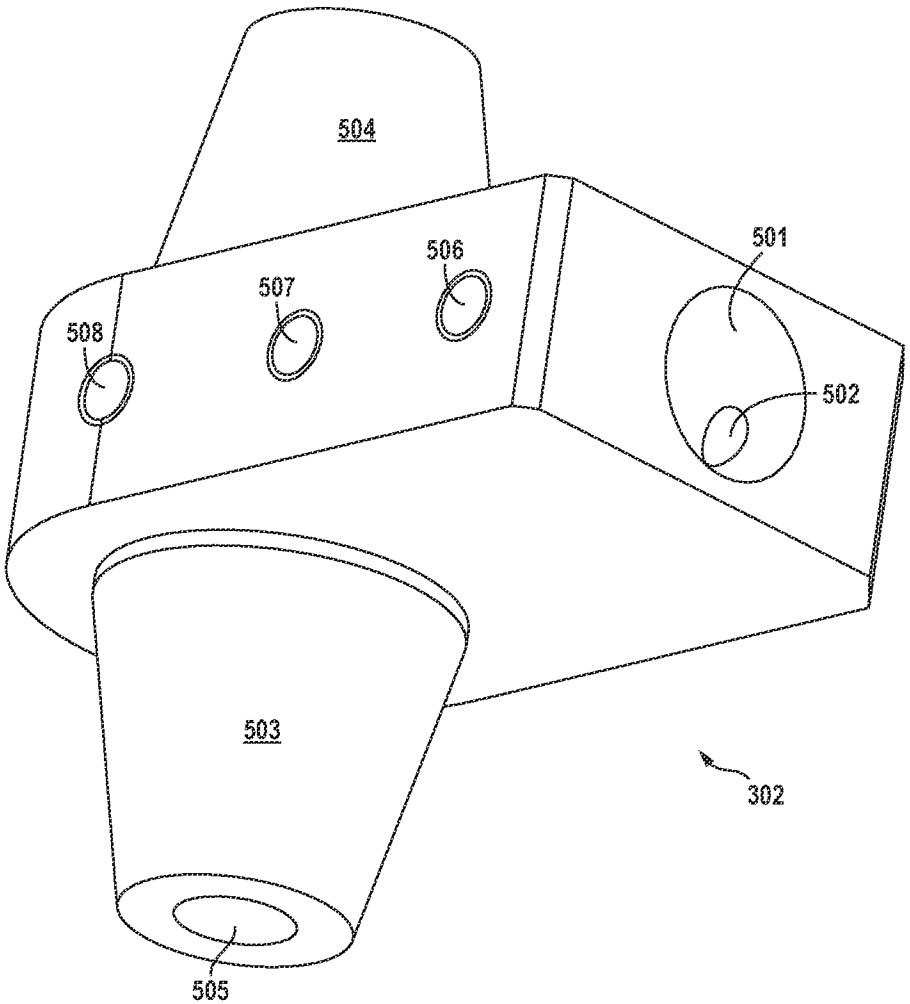
FIG. 5 shows an example hangar.

Hanger 302 is shown in more detail in FIG. 5. Kingpin 208 may engage the hanger through hole 501, where it may in one embodiment be immobilized by set screws 303 (not shown) through holes 502 (one of which is shown in FIG. 5). The hanger may in one embodiment comprise cones 503 and 504 extending toward bearing attachments inside the wheels (not shown). One or more axles may travel through these cones through hole 505, and extend through the wheel. Numerous means for attaching a wheel to an axle are known in the art, and are equivalent for purposes of this disclosure.

Figure 6:
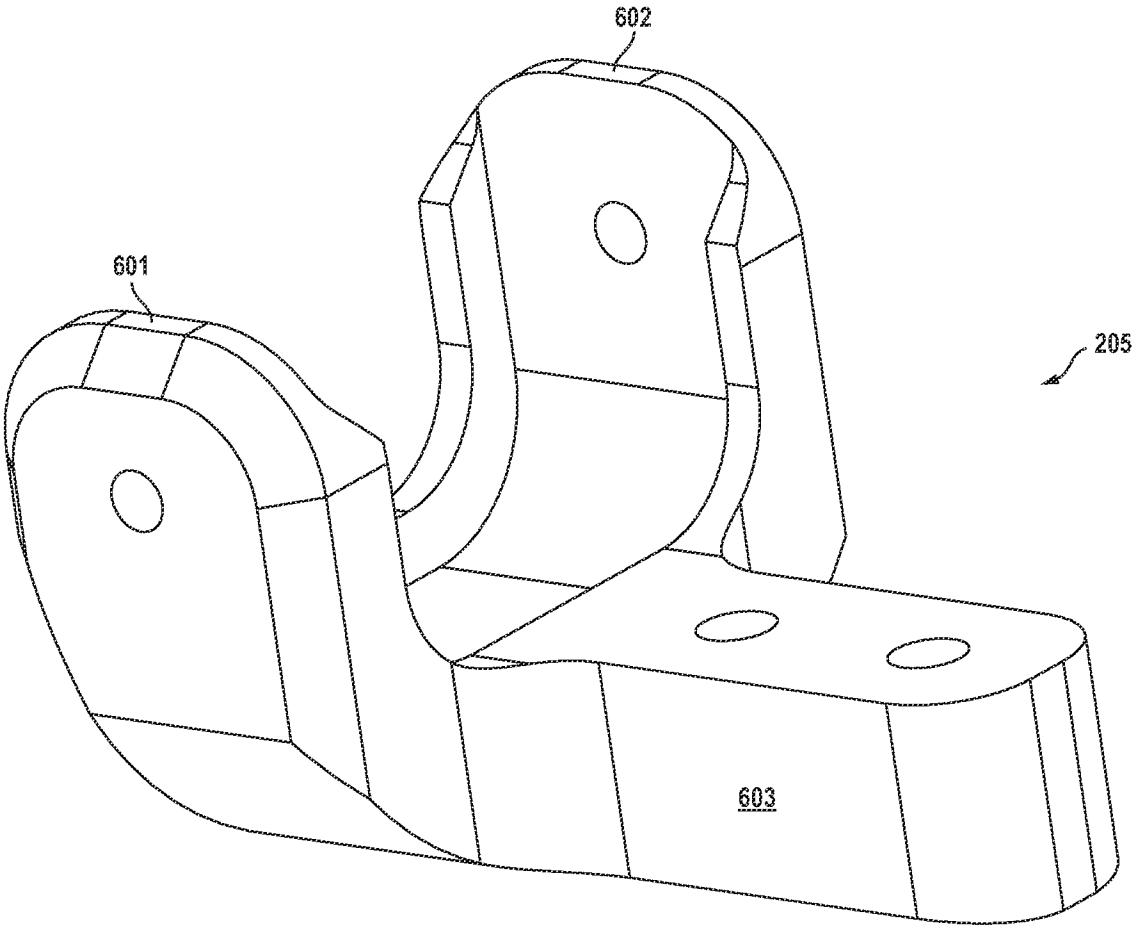
FIG. 6 shows an example bumper yoke.
Figure 7:
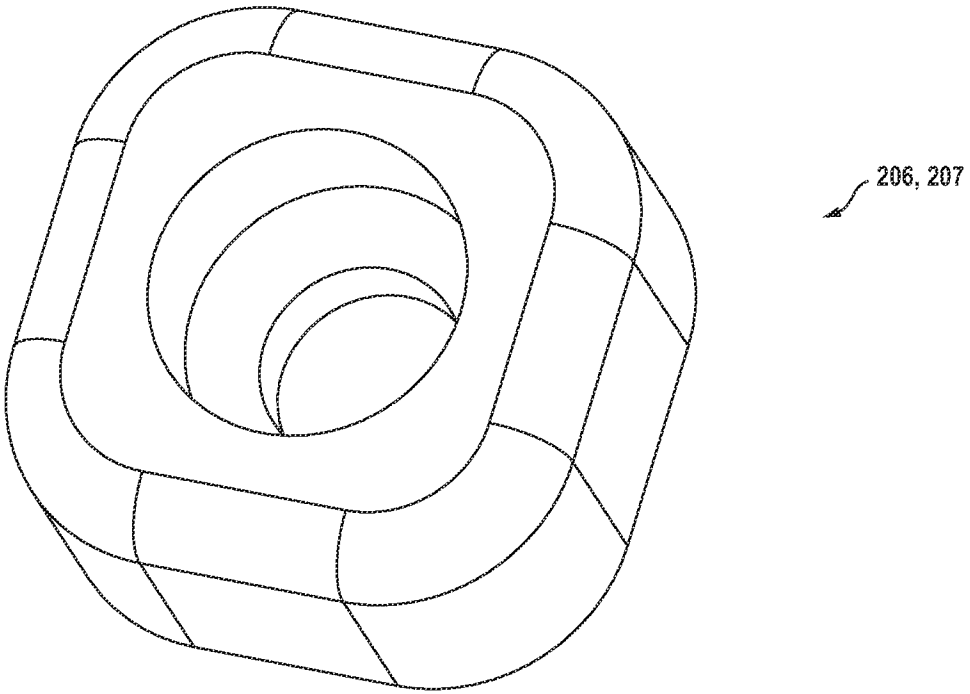
FIG. 7 shows an example elastomeric bumper.
Figure 8C:
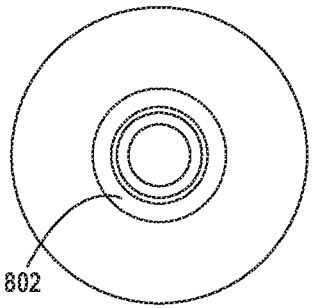
FIG. 8 shows a first example wheel design.
Figure 8B:
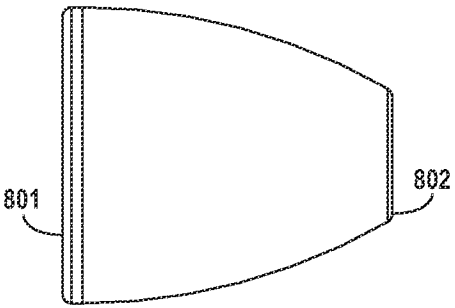
Figure 8A:
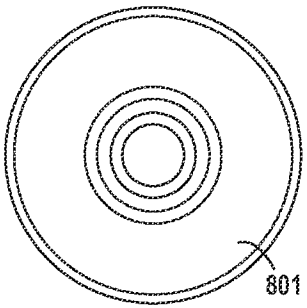
Figure 8D:
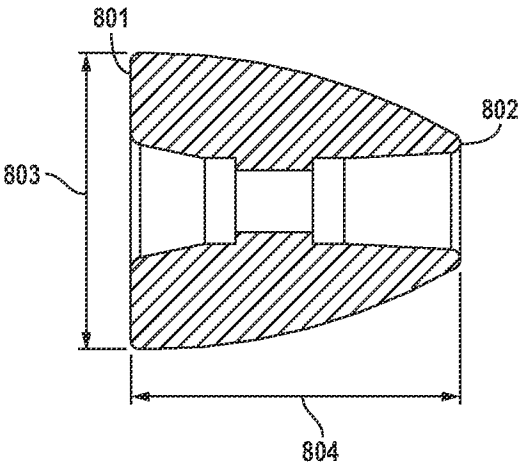

In a preferred embodiment, the hangar 302 may be attached to a bumper yoke 205. In the illustrative embodiment, the attachment is through bolts 210 and 212, passing through bolt holes 506 and 507. Hole 508 may in one embodiment be used to house a set screw for immobilizing the axle. FIG. 6 is an illustrative example showing a bumper yoke 205 suitable for use as part of this disclosure. In this embodiment, the yoke has two arms 601 and 602 extending from the attachment point 603 to the hangar. Within each of the arms, there is preferably provided an elastomeric compliant member 206 or 207, such as the bumper shown in FIG. 7.

In preferable operation, the yoke arms 601 and 602, together with the attached bumpers, are placed adjacent to vertical sections of the base, such as surfaces 404 and 405 of FIG. 4. With arms 601 and 602 straddling part of the base, and the compliant members 206 and 207 between the yoke arms and the base surfaces, the movement of the hangar-yoke assembly is limited by the assertion of an anti-compression force by the compliant members. Thus, as the kingpin rotates in one direction or the other, taking the wheel axis with it, there is a resisting force in the opposite direction that preferably increases as a function of the amount that the wheel axle is displaced from its normal rest position. This force is advantageous to the skateboard rider, as it will balance the rider's weight and any centrifugal forces, making it easier for the rider to steer and maneuver the skateboard by shifting his or her weight.

The bumper may comprise any compliant member known in the art, including elastomeric polymers, springs, or bending cantilevers, all of which operate in an equivalent manner. Preferably, the bumper is an elastomeric polymer which is normally at rest and non-compressed when the wheel axle is in its nominal, or rest state. In this embodiment, turning the wheel in one direction or the other causes compression forces in both bumpers on either side of the yoke.

Among the many advantages of the presently disclosed embodiments are ease in maintenance. Particular embodiments disclosed herein may contains accessible bolts which an owner can remove to replace various parts of the assembly, such as the bumpers or wheels. The owner might, for example be able to use a variety of different wheel shapes, depending on their tastes or the level of stability or performance they desire in their skateboard.

A variety of different wheels may be used with the wheel assembly embodiments disclosed herein. However, a particularly novel class of wheels, as claimed herein, allows for increased maneuverability, as well as the ability to "carve" like the action of a snowboard or surf board.

As a non-limiting example, the profile of the wheel may be tapered, so that the slope of the function representing the diameter as a profile versus the distance from the inside edge of the wheel may have a decreasing slope over at least part of its profile, particularly as the wheel tapers toward its outside edge. From the point of its maximum to the outside edge, this function is preferably monotonically decreasing. It may preferably be monotonically decreasing for essentially the entire length of the wheel, except perhaps for the inside of the wheel, which may in one embodiment be slightly rounded or beveled, which makes little difference to the overall performance of the wheel.

The curve may take a variety of shapes. Preferably, it may be an arc of a circle. In other non-limiting embodiments, it may be a part of an ellipse, spline, parabola, or Bezier curve. The diameter at the edge of the wheel may be substantially smaller than the maximum diameter. The wheel is preferably elongated so that the dimensions of its width are about the same as its diameter, or it is wider than its diameter.

In one embodiment, a wheel can be described by reference to an ideal mathematical surface to which the wheel substantially conforms. Due to machining, molding, or other manufacturing variations, or because of the inherent roughness of the surface, or because of wear-and-tear, the wheel like any other physical object is not precisely a mathematical object, and may vary on the order of several millimeters from any ideally-defined shape. Similarly, two ideal shapes may be substantially, but not identically, the same, and still provide essentially the same performance, stability, and maneuverability to the rider, such that the rider does not detect a significant or noticeable difference during usage. Such differences may be on the order of at least several millimeters. Minor changes in dimension or scale, or slightly lengthening scale in one dimension while keeping the scale in another dimension the same or less, may also provide an insubstantial change to the ideal mathematical shape.

The wheel's mathematical shape may be defined by reference to a rotational axis aligned with the wheel axle. The ideal mathematical surface describing the wheel may take the form of a surface of rotation of a curve around the rotational axis of the wheel. This curve is preferably continuous and smooth. This curve may be plotted in two dimensions, with the x-axis being wheel's axis of rotation, and the y-axis, any radial axis radiating perpendicularly from the wheel's axis of rotation. Thus, the function takes the form $f(x)$, where $f(x)$ is the y-axis coordinate, preferably measured in millimeters, and x is the x-axis coordinate, also preferably measured in millimeters. Measurements of the wheel may have any arbitrary degree of precision, including precision significantly less than a millimeter.

The coordinate x may be defined within a closed interval [a, b] where a represents the outer edge of the wheel, and b represents the inner edge of the wheel, closest to the midline plane of the deck. Preferably, then, $f(x)$ will be monotonically increasing, i.e., $f(a) \leqq f(b)$ for $a<b$, and preferably strictly monotonically increasing within the interval [a, b], i.e. $f(a) < f(b)$ for $a<b$, except in one embodiment for the small region of a beveled edge in the vicinity of $x=b$ which is understood to be an approximation of, and substantially equivalent to, for purposes of the present disclosure, a sharp edged curve that is monotonically increasing on the interval [a, b]. In general, beveled edges are considered to be equivalent to edges without such beveling. A typical beveled region near the inner surface of the wheel, in the vicinity of b, is preferably less than about 5 mm, and most preferably less than about 2 mm.

In one embodiment, $f(x)$ is not monotonically increasing, or strictly monotonically increasing, for the entire interval [a, b], but is only monotonically increasing for some interval [a, c], where $a<c \leqq b$. In this embodiment, $f(c)$ may be a local maximum, and preferably a global maximum within [a, b]. In the interval [c, b], $f(x)$ may be constant or even monotonically decreasing. Preferably, $b-c$ will be less than $c-a$ because it is the monotonically-increasing region of the curve that allows the rotational axis of the wheel to be tipped at a steep angle from its normal horizontal rest angle while the skateboard rider is "carving." Preferably, $b-c$ will be less than 25% of $b-a$, and most preferably, $b-c$ will be as small as possible.

Another way of expressing the monotonically-increasing nature of the curve is to say that the first derivative of $f(x)$ with respect to x is a continuous function of x, and is zero or preferably positive when x is within the interval [a, c]. $f(x)$ will also preferably be a smooth function in that its first derivative with respect to x is continuous.

In one preferred embodiments, $f(a)$ may be less than about 75% of $f(c)$, and in another preferred embodiment, $f(c)$ may be less than about 150% of $b-a$.

In one preferred embodiment, the ideal mathematical surface for each of the four wheels of the skateboard may be the substantially or identically the same. Alternatively, the mathematical surface for the front wheels may be substantially different from the mathematical surface for the rear wheels. In yet another embodiment, one or more of the left wheels may substantially conform to a substantially different ideal mathematical surface from that of one or more of the right wheels. Difference in wheel shape may account for rider preferences. As a non-limiting example, a right-handed rider may desire a different tradeoff between stability and maneuverability while turning left than while turning right.

FIG. 8 shows one embodiment of a wheel for use in this disclosure. FIGS. 8B and D show side views of the wheel, the latter showing the inner details of where the axle and bearings are housed. The wheel has an inner side 801 facing the lateral midline plane of the skateboard, and an outer side 802 facing the opposite direction. FIGS. 8A and C show the back and front views, respectively, with FIG. 8A showing the inner side 801 and FIG. 8C showing the outer side 802. In one preferable embodiment, this design might be scaled so that the back surface diameter 803 is approximately 76.2 mm (3.0 inches). The width 804, in one embodiment could be approximately 84.9 mm (3.34 inches). Preferably, the width is greater than about 50 mm (1.97 inches), and more preferably greater than about 75 mm (2.95 inches).

In some embodiments, the width 804 of the wheel may be larger than the wheel's diameter. However, in other embodiments, the diameter may be much greater than the width, such as when one might use traditional skateboard wheels with a wheel assembly disclosed herein. Traditional skateboard wheels are not as wide as their diameter, because in traditional designs (unlike the present design disclosed herein), excessively wide wheels could decrease the maneuverability of the skateboard.

Preferably, in accordance with the inventions disclosed herein, the diameter of the wheel may be less than about 150% of the width, or more preferably about the same size as the width, or smaller than the width.

Preferably, the outer edge of the wheel 802 is significantly smaller than the wheel's maximum diameter. FIG. 8 shows a design in which the diameter of the wheel is large near the inner edge of the wheel, and gradually tapers to a smaller diameter at the outer edge. In one embodiment, the diameter of the wheel at its outer edge is less than about 75% of the wheel's maximum diameter. Preferably, the outer diameter is less than about 60%, and most preferably, the outer diameter is approximately 50% of the maximum diameter of the wheel, or less. It is possible, in one embodiment, that the wheel does not have an outer edge, but tapers smoothly to a rounded point at its outer side.

Preferably, the slope of the wheel profile increases along the wheel's rotational axis in the direction of the wheel's outer edge. This provides a roughly parabolic shape, which makes it possible for the wheel to make contact with the paved surface while the skateboard axle is at a variety of different angles. with respect to the paved surface. With sufficient curvature near the outside surface of the wheel, it is possible for the skateboard to maintain friction with the road even when the board is at extreme angles, such as when the rider of the board is making a very steep turn, such as what might occur during deep "carving."

Figure 9:
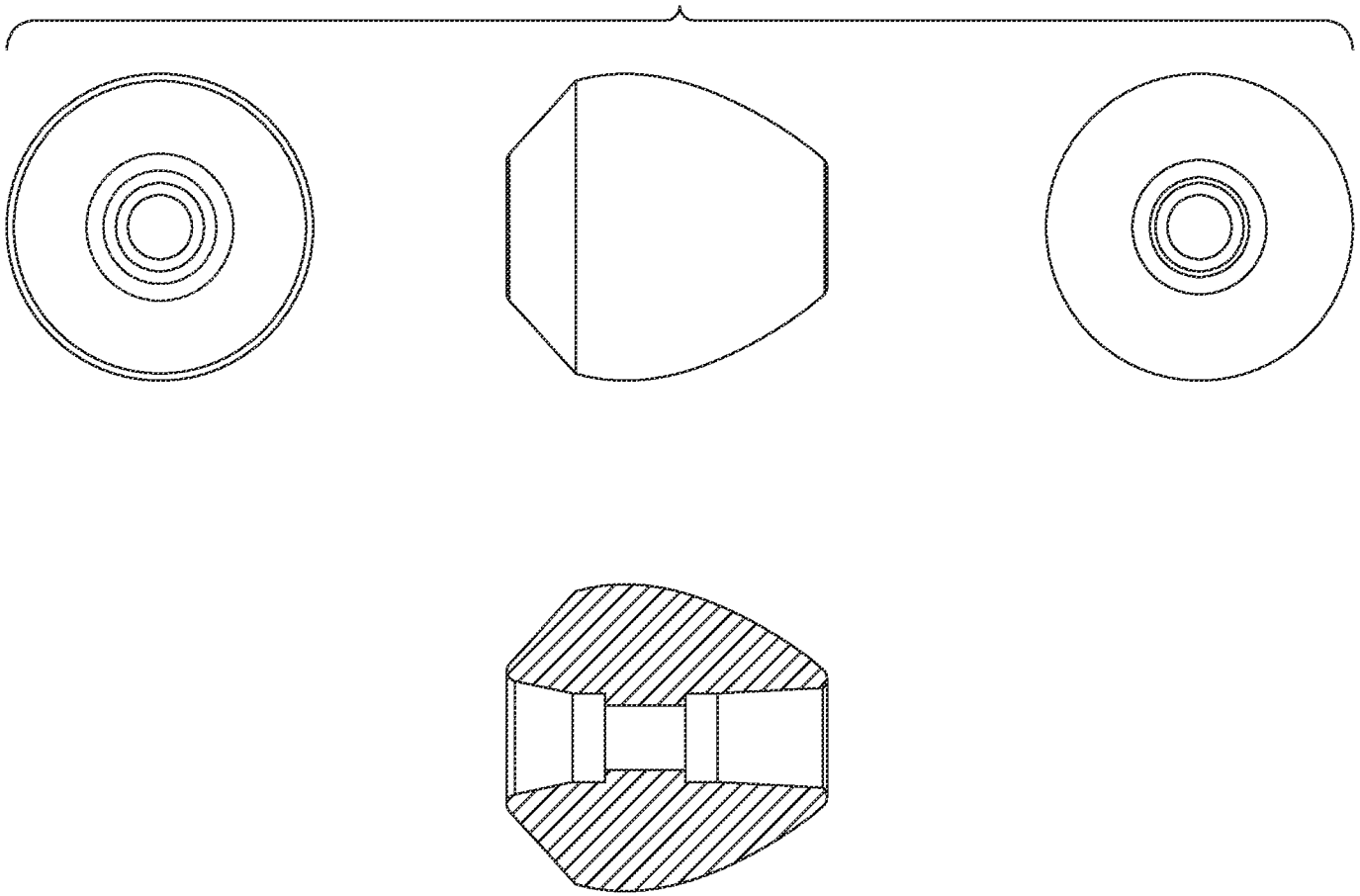
FIG. 9 shows a second example wheel design.
Figure 10:
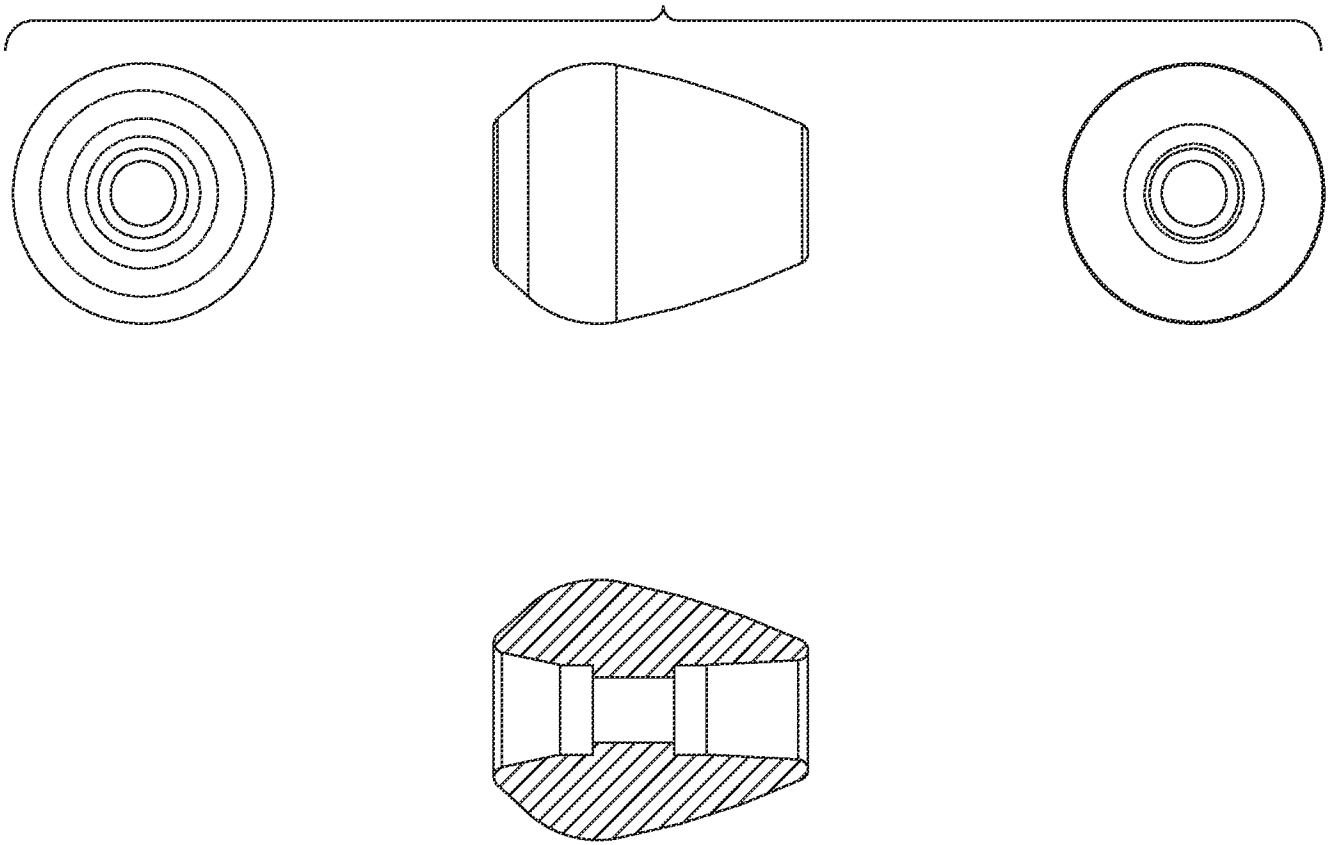
FIG. 10 shows a third example wheel design.

FIG. 9 and FIG. 10 show other embodiments of wheels for use in the present disclosure. In these embodiments, the diameter of the wheel is at its maximum at some point other than adjacent to the inner edge of the wheel. Preferably, the maximum diameter is closer to the inner edge of the wheel than the outer edge, and most preferably, the maximum diameter is at a point less than 25% of the distance from the inner edge to the outer edge of the wheel. Most preferably, the maximum diameter is between about 0 and about 5 mm of the inner edge of the wheel.

Exemplary embodiments have been described with reference to specific configurations. The foregoing description of specific embodiments and examples of the invention have been presented for the purpose of illustration and description only, and although the invention has been illustrated by certain of the preceding examples, it is not to be construed as being limited thereby.

What is claimed is:

1. A skateboard comprising:

a deck, elongated along a longitudinal axis, having front and rear portions with respect to the longitudinal axis, the deck also having a perpendicular vertical axis pointing upward as the board rests on the ground, and a perpendicular lateral axis extending from left to right from the perspective of a rider standing on the board facing the front of the board, separated by a lateral midline into a left side and a right side;

a first wheel assembly attached to the front portion of the board;

a second wheel assembly attached to the rear portion of the board;

wherein the first and second wheel assemblies each comprise a truck and two wheels;

wherein each truck comprises:

a base portion fixedly attached to the board, having a first substantially vertical surface facing the left side of the deck, and a second substantially vertical surface facing the right side of the deck;

a kingpin attached to the base, wherein the kingpin has a longitudinal axis within the lateral midline plane which is at an oblique angle from the horizontal plane of the board;

a hanger attached to the kingpin, so that the hanger is free to rotate about the longitudinal axis of the while the base remains stationary;

one or more axles connected to the hanger;

two axles attached to the hanger, the longitudinal axes of the axles in their nominal position being substantially parallel to the lateral axis of the deck;

a bumper yoke fixedly attached to the hanger, having a first arm and a second arm, the first arm having an inner surface adjacent to said first substantially vertical surface of the base, and the second arm having an inner surface adjacent to said second substantially vertical surface of the base;

a first compliant member disposed between the first arm of the bumper yoke and the first substantially vertical surface of the base, and a second compliant member disposed between the second arm of the bumper yoke and the second substantially vertical surface of the base, wherein the first and second compliant members are configured to provide a compression force that increases as the hanger rotates away from its nominal position around the longitudinal axis of the kingpin.

2. The skateboard of claim 1, wherein the first and second compliant members comprise an elastomeric polymer attached, respectively, to the first and second arms of the bumper yoke.

3. The skateboard of claim 1, wherein the first and second compliant members comprise an elastomeric polymer attached, respectively, to the first and second substantially vertical surfaces of the base.

4. The skateboard of claim 1, further comprising at least four wheels, each wheel attached to one of said axles, wherein each wheel comprises:

an inner edge, nearest the lateral midline of the deck, and an outer edge, furthest from the lateral midline;

wherein the wheel has a substantially circular cross-section within each plane that perpendicularly intersects the wheel's rotational axis, and wherein each cross-section has a diameter which is a function of the distance along the wheel's rotational axis measured from the inner edge of the wheel to the plane of the cross-section;

wherein said diameter, as a function of said distance, is at its maximum value when said distance is less than half of the total width of the wheel from the inner edge of the wheel to the outer edge of the wheel;

wherein the first derivative, with respect to said distance, of the diameter as a function of said distance, is monotonically decreasing as a function of said distance between the point where the diameter is at said maximum value and the outer edge of the wheel;

wherein the diameter at the outer edge of the wheel is less than 75% of said maximum value of the diameter; and wherein said maximum value of the diameter is less than about 150% of said total width of the wheel.

5. The skateboard of claim 4, wherein said angle of the longitudinal axis of the kingpin is between about 40° and about 65°.

6. The skateboard of claim 4, wherein said angle of the longitudinal axis of the kingpin is between about 50° and about 60°.

7. The skateboard of claim 1, wherein each of the two wheels of each of the first and second wheel assemblies is associated with an axle, and wherein each of said wheels comprises:

a rotational axis aligned with the wheel's associated axle; and a wheel surface substantially conforming to a mathematical surface defined independently for each wheel by revolving a continuous, smooth curve about the rotational axis;

wherein the curve may independently for each wheel be uniquely defined as a real function $f(x)$ which is the distance from the rotational axis to the mathematical surface, where x is a distance along the rotational axis defined within a closed interval [a, b], where a corresponds to an outer point along the rotational axis, and b corresponds to an inner point along the rotational axis closer to the lateral midline of the deck than the point corresponding to a, such that b−a is the width of the wheel;

wherein c is a value of x within the interval [a, b] such that $f(c)$ is the maximum value of $f(x)$, and wherein b−c is less than c−a;

wherein the first derivative of $f(x)$ with respect to x is a continuous function of x, and is positive or zero when x is within the interval [a, c];

wherein $f(a)$ is less than about 75% of $f(c)$; and wherein $f(c)$ is less than about 150% of b−a.

8. The skateboard of claim 7, wherein $f(c)$ is less than b−a.

9. The skateboard of claim 7, wherein b−c is less than 25% of b−a.

10. The skateboard of claim 7, wherein $f(a)$ is less than 50% of $f(c)$.

11. The skateboard of claim 7, wherein b−a is at least 75 mm.

12. The skateboard of claim 7, wherein b is approximately equal to c.

13. The skateboard of claim 7, wherein the curve is part of a circle.

14. The skateboard of claim 7, wherein the curve is part of an ellipse.

15. The skateboard of claim 7, wherein the curve is part of a spline curve.

16. The skateboard of claim 7, wherein the curve is part of a parabola.

17. The skateboard of claim 7, wherein the curve is part of a Bezier curve.

18. The skateboard of claim 7, wherein the curve is substantially the same for the four wheels consisting of the two wheels of the first wheel assembly and the two wheels of the second wheel assembly.

19. The skateboard of claim 7, wherein, for at least one of the wheel assemblies, the curve for one of the two wheels comprising that wheel assembly is substantially different from the curve for the other one of the two wheels comprising that wheel assembly.

20. The skateboard of claim 7, wherein the curve for at least one wheel for the first wheel assembly is substantially different from the curve for at least one wheel for the second wheel assembly.

* * * * *